United States Patent [19]

Pace

[11] 4,050,168

[45] Sept. 27, 1977

[54] FOOTWEAR WITH DETACHABLE SYMBOLS

[76] Inventor: Carl E. Pace, 2059 N. Maple Trail, Wixom, Mich. 48096

[21] Appl. No.: 695,796

[22] Filed: June 14, 1976

[51] Int. Cl.[2] ..... A43B 23/00; A43B 3/28; A43B 13/12

[52] U.S. Cl. ..... 36/136; 36/30 R; 36/112

[58] Field of Search ..... 36/7.5, 7.6, 1, 25, 36/112, 136, 30 R

[56] References Cited

U.S. PATENT DOCUMENTS

| | | | |
|---|---|---|---|
| 1,984,989 | 12/1934 | Reed | 36/136 |
| 2,754,598 | 7/1956 | Aull | 36/1 |
| 3,494,055 | 2/1970 | McSorley | 36/59 R |
| 3,903,620 | 9/1975 | Gillet | 36/25 R |

*Primary Examiner*—Patrick D. Lawson

*Attorney, Agent, or Firm*—Gifford, Chandler, Sheridan & Sprinkle

[57] ABSTRACT

An attachment for footwear having a sole is provided and comprises at least one raised symbol detachably mounted to the sole by a pressure sensitive adhesive. With the symbol or symbols arranged as desired on the sole, the outline of the symbol is imprinted on a soft ground supporting surface as the sole engages the ground by walking or the like.

5 Claims, 3 Drawing Figures

FOOTWEAR WITH DETACHABLE SYMBOLS

BACKGROUND OF THE INVENTION I. Field of the Invention

The present invention relates generally to footwear, and, more particularly, to an attachment for footwear for imprinting symbols on a ground supporting surface.

II. Description of the Prior Art

Footwear, such as shoes or sandals, typically includes a relatively flat sole, the outline of which is imprinted into a soft ground supporting surface, such as sand or soil, as the wearer walks upon the ground. Due to the similarity between different tracks imprinted into the ground by these previously known footwear, differentiation between the tracks is difficult if not impossible.

One previously known footwear sole for imprinting distinctive animal track marks into soft soil is described in Pat. No. 3,402,485 which issued on Sept. 24, 1968 to P. E. McMorrow. McMorrow discloses a molded sole which mounts over and covers the already existing footwear sole. Projecting sole portions are integrally formed with the molded sole and project outwardly from the bottom of the sole. The projecting sole portions imprint the desired animal tracks into the soil as the wearer walks upon the ground.

One disadvantage of the McMorrow sole is that the entire molded sole must be removed and replaced as a unit in order to obtain a different imprint or track upon the soil. Replacement of the entire molded sole as required by McMorrow is not only expensive but also prevents the wearer from constructing an original track design for the sole.

SUMMARY OF THE INVENTION

The present invention overcomes the above mentioned disadvantages of the previously known footwear soles by providing raised symbols which are detachably mounted to the base of the sole.

An adhesive is applied to one side of each symbol and the symbol or symbols are attached in the desired pattern onto the base of a relatively flat sole. The adhesive preferably is pressure sensitive so that the symbol may be subsequently detached from the sole and a new and different symbol thereafter applied to the sole.

After attachment of the symbol to the base of the sole, upon walking on soft soil, sand, snow or the like, a track of the symbol is imprinted into the ground due to the weight of the wearer upon the sole. A raised border is preferably provided around the outer periphery of the sole and serves to outline the track of the symbol on the ground.

BRIEF DESCRIPTION OF THE DRAWINGS

A better understanding of the present invention will be had upon reference to the following detailed description when read in conjunction with the accompanying drawing, wherein like reference characters refer to like parts throughout the several views and in which.

DETAILED DESCRIPTION OF THE PRESENT INVENTION

Figure 1:
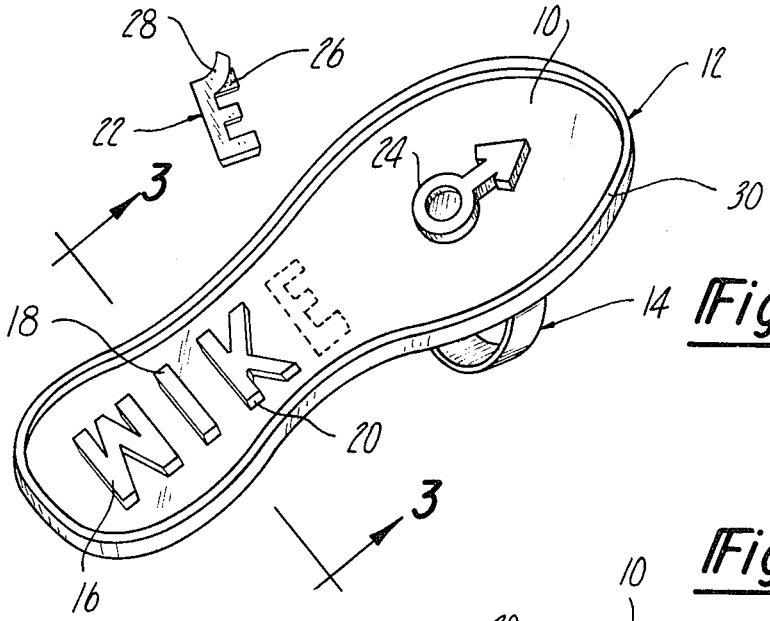
FIG. 1 is a bottom plan view of a footwear sole and showing the attachment of the raised symbol according to the present invention.

With reference first to FIG. 1 the bottom 10 of a footwear sole 12 is there shown and is preferably flat and untextured. The footwear may comprise a sandal, a shoe, or the like but, as shown in FIG. 1, is a sandal 14.

Figure 3:
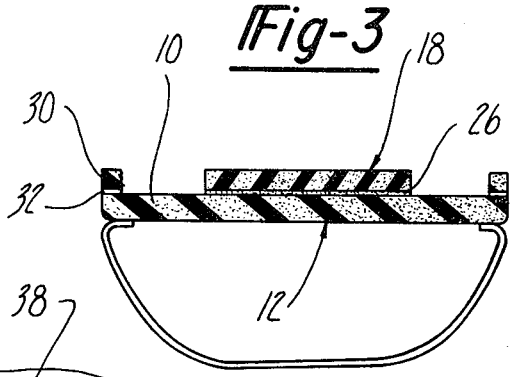
FIG. 3 is a cross-sectional view taken substantially along line 3—3 in FIG. 1 and enlarged for clarity.

A plurality of symbols 16, 18, 20, and 22 are provided which together form the mirror image of the word "MIKE" and a symbol 24 for a man are illustrated in FIG. 1 with symbols 16–20 and 24 already attached to the bottom 10 of the sole 12. With reference to FIGS. 1 and 3, the symbol 22 is there shown with a pressure sensitive adhesive 26 which covers one side of the symbol 22. A sheet 28 of paper or the like covers the adhesive layer 26 and protects it from dirt and debris.

When attachment of the symbol 22 to the bottom 10 of the sole 12 is desired, the protective sheet 28 is removed from the symbol 22 which exposes the adhesive layer 26. The symbol 22 is then positioned and pressed onto the bottom 10 of the sole 12 with the adhesive 26 against the sole 12, as shown by the outline 22, thus attaching the symbol 22 to the sole 12.

The raised symbol may take any desired form and several different shaped symbols 16–24 are illustrated in FIG. 1. However, each of the raised symbols are attached to the sole 12 in substantially the same manner. For example, as illustrated by the attachment of the symbol 18 in FIG. 3, the adhesive layer 26 is sandwiched between the symbol 18 and the bottom 10 of the sole 12. Moreover, each of the symbols 16–24 is preferably of the same depth D.

With reference to FIGS. 1 and 3, preferably a raised border 30 is provided around the entire outer periphery of the sole 12. The border 30 may form part of the sole 12 or may be attached thereto by an adhesive layer 32 (FIG. 3) and in addition is preferably of the same depth D as the symbols 16–24.

Figure 2:
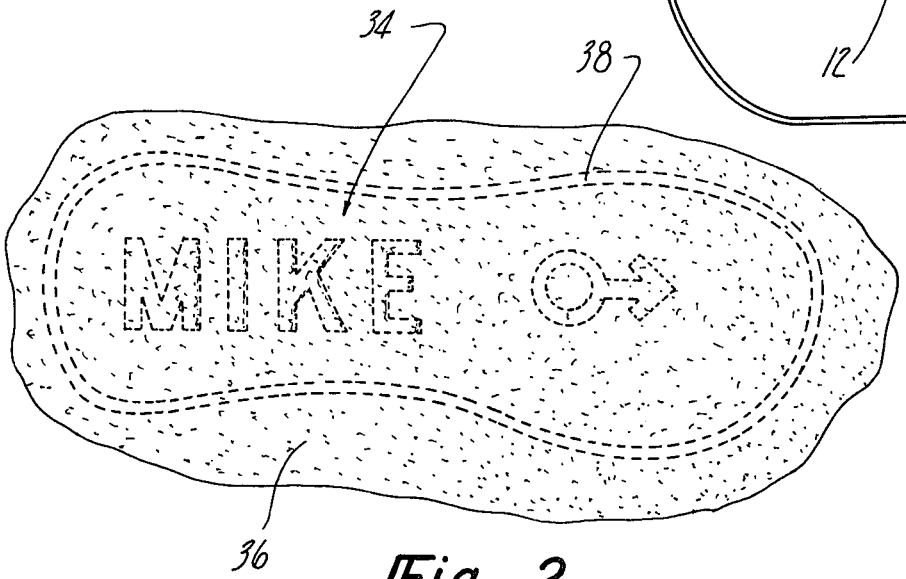
FIG. 2 is a fragmentary perspective view showing one track imprinted upon the ground supporting surface utilizing the footwear attachment of the present invention.

With reference to FIG. 2, with each of the raised symbols 16–24 and the border 30 attached to the sole 12 of the footwear 14, an imprint or track 34 is formed in a soft ground supporting surface 36 due to the weight of the wearer exerted on the sole 12 while walking. The ground supporting surface 36 may be soft soil, sand, snow or the like which not only permits but also retains the imprint 34. Moreover it should also be understood that the imprint 34 is a mirror image of the symbol 16–24 as viewed in FIG. 1.

Still referring to FIG. 2 the border 30 forms a closed loop imprint 38 which encircles the imprint 34 and provides an overall pleasing appearance for the imprint 34. The border 30, however, serves a still further function in that the border achieves a more even distribution of the weight of the wearer onto the ground supporting surface 36. A more even distribution of the weight on the sole not only protects the wearer from foot and back aches, but also increases the stability of the footwear when walking upon a hard surface, such as concrete. In addition, the border 30 absorbs a portion of the wearer's weight and protects the raised symbols 16–24 from damage from a hard support surface.

In the preferred form of the invention the adhesive layer 26 is pressure sensitive as previously described. This permits any or all of the raised symbols 16–24 to be detached from the bottom 10 of the sole 12 when and if desired. After detachment of the symbols 16–24 from the sole 12, a new set of symbols may be attached to the bottom 10 of the sole 12 in any desired pattern. Consequently, unlike the previously known imprinting footwear soles the tracks, imprinted onto the ground with the present invention, may be easily, rapidly and inexpensively altered according to the moods and desires of the wearer.

It can thus be seen that the present invention provides an inexpensive, simple and yet totally effective means whereby the wearer of footwear may imprint distinctive tracks upon a ground supporting surface. The tracks not only provide a simple means for tracking down elusive children but may also be used by adults for mere amusement.

Having thus described my invention many modifications thereto will become apparent to those skilled in the art to which it pertains without deviation from the spirit of the invention as defined by the scope of the appended claims.

What is claimed is:

1. A footwear having a sole adapted to engage a ground supporting surface, a raised border of resilient material detachably attached to and extending around the entire periphery of said sole, means for detachably attaching said border to said sole means detachably attached to said sole within said border comprising at least one raised symbol and means for detachably attaching said symbol to the sole of said footwear whereby said symbol is imprinted on said ground supporting surface as said sole engages said ground supporting surface.

2. A footwear as defined in claim 1 and including means adhesively attaching said border to said sole.

3. The invention as defined in claim 1 wherein said means comprises an adhesive layer on one side of said symbol.

4. The invention as defined in claim 1 wherein said border and said symbol are substantially the same thickness.

5. The invention as defined in claim 3 wherein said adhesive is pressure sensitive.

* * * * *